US010837676B2

(12) United States Patent
Boros et al.

(10) Patent No.: US 10,837,676 B2
(45) Date of Patent: Nov. 17, 2020

(54) ELECTRIC WATER HEATER HAVING A BYPASS

(71) Applicant: Rheem Manufacturing Company, Atlanta, GA (US)

(72) Inventors: Jozef Boros, Montgomery, AL (US); Sina Jasteh, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 148 days.

(21) Appl. No.: 15/960,363

(22) Filed: Apr. 23, 2018

(65) Prior Publication Data

US 2019/0323731 A1 Oct. 24, 2019

(51) Int. Cl.

| | |
|---|---|
| ***F24H 9/12*** | (2006.01) |
| ***F24D 19/08*** | (2006.01) |
| ***F24H 9/20*** | (2006.01) |
| ***F24H 9/14*** | (2006.01) |
| ***F24H 1/20*** | (2006.01) |
| ***F24H 1/18*** | (2006.01) |

(52) U.S. Cl.

CPC ..... *F24H 9/2021* (2013.01); *F24H 1/181* (2013.01); *F24H 1/202* (2013.01); *F24H 9/142* (2013.01)

(58) Field of Classification Search

CPC . F24H 1/18; F24H 1/0018; F24H 1/00; F24H 9/124; F24H 9/126; F24D 19/088

See application file for complete search history.

(56) References Cited

U.S. PATENT DOCUMENTS

| | | | | |
|---|---|---|---|---|
| 3,190,284 | A * | 6/1965 | Koepf | F24H 9/124 126/362.1 |
| 3,685,542 | A | 8/1972 | Daughirda | |
| 3,840,175 | A | 10/1974 | Jacuzzi | |
| 4,305,547 | A * | 12/1981 | Cohen | F24H 1/208 122/15.1 |
| 4,936,289 | A | 6/1990 | Peterson | |
| 5,096,145 | A | 3/1992 | Phillips et al. | |
| 5,261,443 | A | 11/1993 | Walsh | |
| 5,347,956 | A * | 9/1994 | Hughes | F24H 9/124 122/14.3 |
| 5,368,013 | A | 11/1994 | Herweyer | |
| 5,655,710 | A | 8/1997 | Kayahara et al. | |
| 6,370,328 | B1 * | 4/2002 | Mottershead | F24H 1/202 126/639 |

(Continued)

FOREIGN PATENT DOCUMENTS

| | | |
|---|---|---|
| CN | 202470456 | 10/2012 |
| GB | 1169383 | 11/1969 |
| GB | 2315855 | 2/1998 |

OTHER PUBLICATIONS

Certified copy of Australian Application No. 2012901168, filed Mar. 22, 2012.

(Continued)

*Primary Examiner* — Gregory A Wilson
(74) *Attorney, Agent, or Firm* — Troutman Pepper Hamilton Sanders LLP

(57) ABSTRACT

A water heater includes a tank defining an interior volume having an inlet and an outlet, a heating element configured to heat water within the tank, and a bypass in fluid communication between the inlet and outlet and configured to divert at least a portion of the supply water from the inlet to the outlet.

21 Claims, 10 Drawing Sheets

(56) References Cited

U.S. PATENT DOCUMENTS

| | | | | |
|---|---|---|---|---|
| 7,971,603 | B2 * | 7/2011 | Willis | F28F 9/02 137/454.6 |
| 9,268,342 | B2 * | 2/2016 | Beyerle | G05D 23/1346 |
| 10,215,445 | B1 * | 2/2019 | Mottershead | F24H 9/2007 |
| 2009/0145490 | A1 | 6/2009 | Kershisnik | |
| 2012/0063755 | A1 | 3/2012 | Lucker et al. | |
| 2013/0247997 | A1 | 9/2013 | Ng et al. | |
| 2017/0059208 | A1 | 3/2017 | Chaudhry | |
| 2019/0041095 | A1 * | 2/2019 | Boros | F24H 9/2035 |

OTHER PUBLICATIONS

International Search Report for PCT/US2019/028565 dated Aug. 21, 2019.

* cited by examiner

ELECTRIC WATER HEATER HAVING A BYPASS

FIELD OF THE INVENTION

The present invention relates generally to a water heater and, more particularly to a water heater having a bypass.

BACKGROUND OF THE INVENTION

Electric water heaters are used to heat and store a quantity of water in a storage tank for subsequent on-demand delivery to plumbing fixtures such as sinks, bathtubs and showers in both residences and commercial buildings. Electric water heaters typically utilize one or more electric resistance heating elements to supply heat to the tank-stored water. Fuel burning water heaters typically utilize one or more burners at which is burned natural gas, or other combustible material, to supply heat to the tank's stored water. Activation and deactivation of such heating elements, whether electric or fuel-burning, may be controlled by a controller that responds to signals from a temperature sensor in thermal communication with the tank water (e.g. a sensor mounted on the tank wall) that monitors the temperature of the stored water, actuating and deactuating the water heater in response to comparison of the water temperature with high and low set points, as should be understood.

Water heaters may generally be limited in their ability to deliver water within the set point range by the amount of stored heated water in the storage tank. The water heater discharges water from the storage tank at a predetermined temperature maintained (e.g. within a predetermined temperature range defined by the set points) by the control system's control of the heating system, and therefore the water temperature, to the set points until a sufficient amount of the stored heated water is drawn from the tank such that cold water entering the tank from a municipal water supply offsets the water tank outflow and reduces water outflow temperature. In some instances, the outlet temperatures of the water heater may be limited due to safety regulations or concerns, energy regulations or concerns, or the like.

SUMMARY OF THE INVENTION

The present invention recognizes and addresses considerations of prior art constructions and methods.

In one embodiment, a water heater includes a tank defining an interior volume having an inlet and an outlet. A heating element is disposed with respect to the volume to heat water within the tank. A dip tube is operably coupled to the inlet and configured to discharge supply water in a lower half of the interior volume. A bypass conduit is in fluid communication between the inlet and outlet so that the bypass conduit diverts to the outlet at least a portion of the supply water from the inlet when the supply water flows through the inlet, wherein the bypass conduit defines a fixed open fluid channel extending from the inlet to the outlet.

In another embodiment, a water heater includes a tank defining an interior volume having an inlet and an outlet. A heating element is disposed with respect to the volume to heat water within the tank. A bypass conduit is disposed within the interior volume, in fluid communication between the inlet and outlet so that the bypass conduit diverts to the outlet at least a portion of the supply water from the inlet when the supply water flows through the inlet, wherein the bypass conduit defines a fixed open fluid channel extending from the inlet to the outlet.

In a still further embodiment, a water heater includes a tank defining an interior volume having an inlet and an outlet, a heating element disposed with respect to the volume to heat water within the tank, a water inlet line attached to the tank in fluid communication with the interior volume so that, when connected to a pressurized water source, the water inlet line extends into the interior volume and injects water therein, and a water outlet line attached to the tank in fluid communication with the interior volume so that, when the water outlet line is in fluid communication with a low pressure water source, the water outlet line draws water from the tank. A water bypass conduit is disposed within the interior volume in fluid communication with and extending between the water inlet line and the water outlet line so that the bypass conduit diverts to the water outlet line at least a portion of water from the inlet when the water flows through the inlet, wherein the bypass conduit defines a fixed open fluid channel extending from the water inlet line to the water outlet line.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
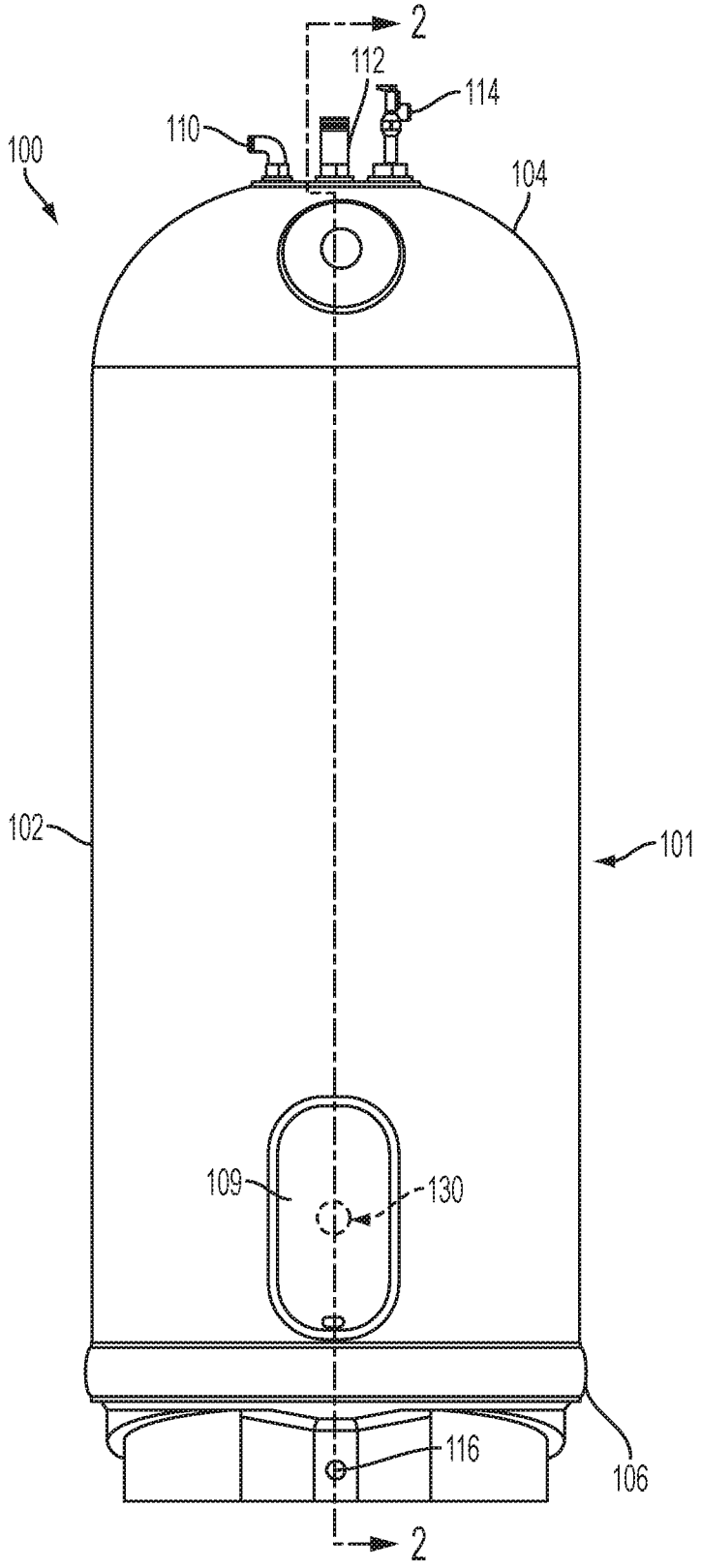
FIG. 1 is a front plan view of a water heater according to an example embodiment.

Repeat use of reference characters in the present specification and drawings is intended to represent same or analogous features or elements of the invention according to the disclosure.

DETAILED DESCRIPTION

Reference will now be made in detail to example embodiments of the water heater, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
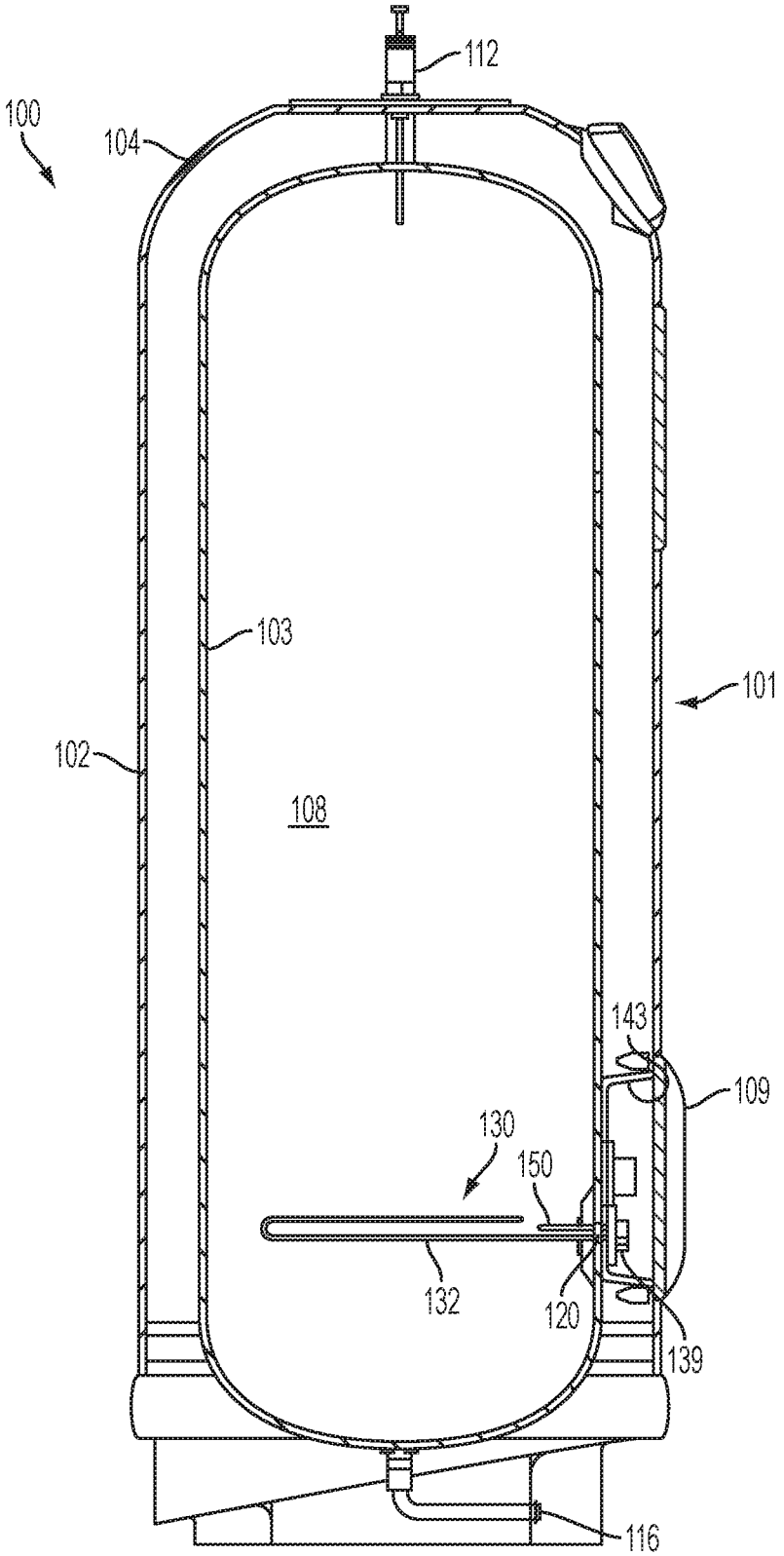
FIG. 2 is a cross-sectional side view of the water heater shown in FIG. 1, taken along line 2-2 according to an example embodiment.
Figure 3:
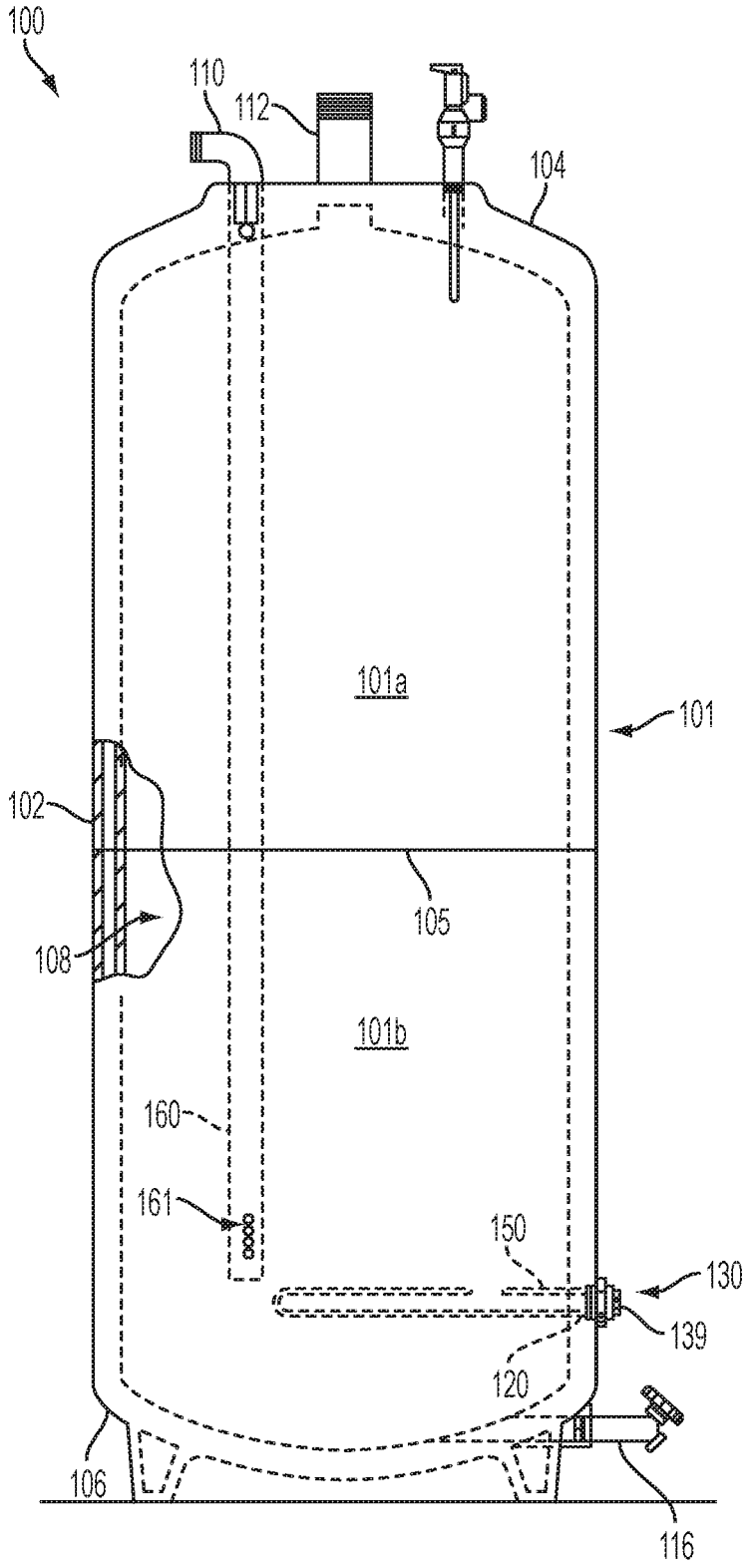
FIG. 3 is a side view of an embodiment of a water heater including a partial cut-away view of the side wall according to an example embodiment.

As used herein, terms referring to a direction, or a position relative to the orientation of the water heater, such as but not limited to "vertical," "horizontal," "upper," "lower," "above," or "below," refer to directions and relative positions with respect to the water heater's orientation in its normal intended operation, as indicated in FIGS. 1 through 3 herein. Thus, for instance, the terms "vertical" and "upper" refer to the vertical orientation and relative upper position in the perspective of FIGS. 1 through 3, and should be understood in that context, even with respect to a water heater that may be disposed in a different orientation. As used herein, operable coupling should be understood to relate to direct or indirect connection that, in either case, enables functional interconnection of components that are operably coupled to each other.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Referring now to FIGS. 1 and 2, a water heater 100 may include a tank including a vertically oriented, generally cylindrical body 101, which may be defined by an outer wall having a domed top head portion 104, a bottom pan portion 106, a generally cylindrical side wall 102 extending therebetween and having an annular cross-section in a plane normal to the body's cylindrical center axis, and a seamless, one-piece liner 103 disposed therein that defines an interior volume 108 for receiving and holding water. As shown, side wall 102 may be formed of steel, aluminum, or a reinforced polypropylene-based polymer material, but it will be understood from the present disclosure that in other embodiments, other suitable polymers or other materials may be utilized for sidewall 102, head 104, and pan 106. As should also be apparent from the present disclosure, the wall's construction and configuration may also vary, and the present disclosure is not limited to the constructions of the specific examples discussed herein. In another embodiment, for example, and referring to FIG. 3, body 101 may be formed of upper and lower body portions 101*a* and 101*b* that are independently molded and may later be joined at a seam 105. Body portions 101*a* and 101*b* may be formed of a double walled construction, rather than the wall-and-bladder arrangement illustrated in the embodiment of FIG. 2. The process by which body portions 101*a* and 101*b* are manufactured is discussed in greater detail in U.S. Pat. No. 5,923,819, issued Jul. 13, 1999, the entire contents of which are incorporated herein by reference, and a detailed description of the process is therefore not repeated herein.

As shown in FIGS. 1 and 2, a cold water inlet pipe 110, a hot water outlet fitting 112 and a temperature and pressure release valve 114 may extend through suitable openings defined in the water heater's domed top head portion 104. A valve drain pipe 116 may extend inwardly through bottom pan portion 106. An electric resistance heating assembly 130 may extend radially inwardly into interior volume 108 through an aperture 120 formed in a recessed housing 143 disposed and extending between liner 103 and side wall 102 of the water heater's body 101. While one heating element assembly 130 is illustrated in the present Figures, it should be understood that this is for example only and that the water heater may include more than one heating element assembly, e.g. two electric resistance heating elements, one in the lower portion of the tank volume and one in the upper portion of the tank volume. Housing 143 may include or cooperate with a cover 109, which may cover electrical fittings 139 of the electric resistance heating assembly 130 and may extend outwardly from the side wall of water heater 100. A power source may provide electric current to the heating elements of electric resistance heating assembly 130 through the electrical fittings 139, and a control board may communicate with a temperature sensor 150 of associated with the electric resistance heating assembly 130 through the electrical fittings 139.

In operation, cold water from a pressurized source, e.g. a municipal water supply, may flow through cold water inlet pipe 110 into interior volume 108 of water heater 100, wherein the water is heated by electric resistance heating assembly 130 and stored for later use. In response to a demand from one or more plumbing fixtures to which water heater 100 is connected within a building or other facility, the stored heated water within interior volume 108 of water heater 100 may flow outwardly through hot water outlet fitting 112 to the plumbing fixtures by way of hot water supply piping, as understood in this art. The discharge of heated water outwardly through hot water outlet fitting 112 creates capacity within interior volume 108 that is correspondingly filled by the supply water that flows downwardly through cold water inlet pipe 110 and into interior volume 108. Water heater 100 may include a dip tube 160 (FIG. 3) operably coupled to cold water inlet 110. Dip tube 160 is an elongated hollow tube that conveys the cold water through its interior fluid passage down from cold water inlet 110 to outlet apertures 161 in the lower half of interior volume 108, e.g. proximate the tank bottom. As should be understood, since warmer water rises to the top of the water tank volume, and since hot water outlet fitting 112 is at the top of the tank, the injection of cold water into the tank volume at the tank volume's bottom half allows outlet fitting 112 to draw hot water from the tank for a longer period of time than would occur if cold water were injected into the tank volume's upper portion, in that injection of the cold water into the tank volume's upper portion would more quickly cool the water being drawn from the outlet fitting. The tank water may be heated by electric resistance heating assembly 130. The water proximate to the electric resistance heating assembly 130, being warmer and therefore less dense than the colder water, rises upward toward the top of the water heater 100 due to natural circulation.

In an example embodiment, hot water outlet fitting 112 may be configured to draw heated water from the upper portion of the interior volume 108, such as the top quarter, third, or half of the interior volume 108. Similarly, cold water inlet pipe 110 may be configured, via dip tube 160, to discharge supply water in the bottom portion of the interior volume 108, such as the bottom quarter, third, or half of that volume. As noted above, since the supply water is discharged in the bottom portion of water heater 100, and the heated water is withdrawn from the top of water heater 100, an outlet temperature may remain relatively steady until the warm water in interior volume 108 is generally replaced by the cold supply water.

Processing circuitry includes a controller that monitors a temperature of water in the tank based on a signal received from temperature sensor 150. The processing circuitry actuates the one or more heating elements of electric resistance heating assembly 130 in response to sensing (via a signal sent to the controller from the temperature sensor) an ambient water temperature below a predetermined low threshold value stored in memory accessible to the controller and maintains the heating element(s) in an actuated state until the controller senses a water temperature above a predetermined high threshold value, where the high threshold is greater than the low threshold. While, in the present example, the control system relies upon temperature sensor 150 utilized in the heating element assembly 130, it should be understood that this is for purposes of example only and that the control system may include a separate temperature sensor for this purpose, for example attached to the tank wall to thereby detect water temperatures through the wall. Further, one of ordinary skill in the art should immediately appreciate that the electric resistance heating assembly 130 is merely an example heating element and that other heating elements may be utilized, such as a fuel burning heating element including a natural gas burner, or the like.

Figure 4:
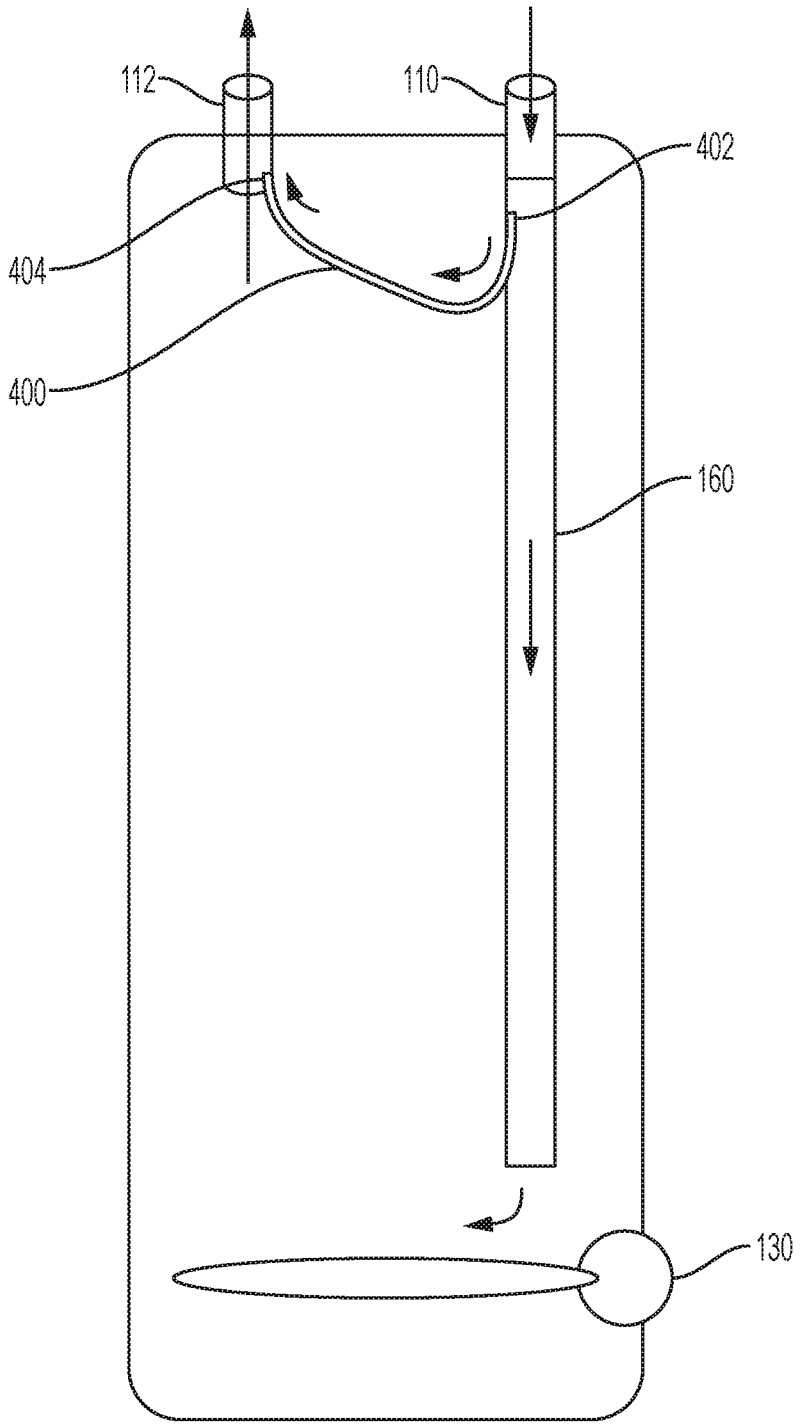
FIG. 4 is a schematic view of the water heater including a bypass according to an example embodiment.

FIG. 4 illustrates a cross-sectional view of water heater 100, including a bypass conduit 400 according to an example embodiment. Bypass conduit 400 may be in fluid communication between cold water inlet pipe 160 and hot water outlet fitting 112 as described herein. The bypass diverts a portion of the supply water from cold water inlet pipe 110/160 to hot water outlet fitting 112. In some embodiments, bypass conduit 400, in this embodiment an elongated tube, may be disposed within interior volume 108. In an example embodiment, a receiving end 402 of bypass conduit 400 is operably coupled to dip tube 160, such as disposed in connection with a penetration of a side wall of dip tube 160. In an example embodiment, a discharge end 404 of bypass conduit 400 is disposed proximate to or within hot water outlet fitting 112.

The diverted supply water mixes with the heated water flowing out of the tank via hot water outlet fitting 112. The mixing of the diverted water and the heated water lowers the overall temperature of the water exiting the hot water outlet fitting 112 to a temperature less than the temperature at which heating element assembly 130 maintains the water in interior volume 108. Since the water exiting hot water outlet fitting 112 is at a lower temperature, water heater 100 may supply heated water to plumbing fixtures under continuous flow for a period of time greater than would be possible without the cold water mixing by raising the predetermined low and high set point values for controlling the electric resistance heating assembly 130. For example, in a typical water heater, the stored heated water may be maintained by the water heater's heating element(s) at, or near, 125 degrees Fahrenheit, so that the water exiting the water heater is approximately 125 degrees until the volume of stored heated water is sufficiently depleted that cold water injected into the lower part of the tank volume begins to be drawn out of outlet 112. In an example embodiment of water heater 100, the stored heated water may be maintained by the heating element(s) in the tank volume at a higher temperature, such as 145 degrees Fahrenheit. Since the water exiting water heater 100 is a combination of the diverted (cold) water from the bypass conduit 400 and the stored heated water, the dimensions of bypass conduit 400 are established to a predetermined ratio with respect to the corresponding dimensions of outlet 112, so that the cold water from bypass conduit 400 mixes with the 145 degree Fahrenheit water from the storage tank, providing mixed water at a temperature of 125 degrees Fahrenheit, i.e. similar to the typical water heater water output temperature. Because of the inclusion of the cold water from the bypass conduit, the rate of withdrawal of hot water from the tank is lower than it would be in the absence of the bypass conduit. As a result, the water tank maintains a temperature at or near 125 degrees Fahrenheit for a period of time greater than would occur without the bypass conduit and increased set points.

The portion of the flow of water flowing through bypass conduit 400, compared to the total amount of water flowing into the tank through water inlet pipe 110 (e.g. the amount of water in bypass conduit 400, divided by the sum of the water flowing through conduit 400 and water flowing through dip tube 160 below the split from conduit 400) depends upon the cross-sectional diameter of bypass 400 compared to the sum of the cross sectional areas of bypass 400 and dip tube 160. As should be understood, this ratio remains substantially constant, regardless of the input water pressure. Since the amount of water exiting the water heater through outlet 112 is always equal to the amount of water entering the tank through inlet 110, this ratio is also the ratio of the water contributed by bypass 400 to the total amount of water exiting the tank through outlet 112. The portion of the flow of water exiting water heater 100 through hot water outlet fitting 112 from bypass conduit 400 may therefore depend upon the length and the cross-sectional diameter or area of the generally circular cross-sectional internal volume of the central tube portion of bypass 400, compared to the sum of cross-sectional diameters or areas of bypass 400 and the cross-sectional diameter or area of the generally circular cross-sectional internal volume of dip tube 160. The ratio of the flow of water from bypass conduit 400 (considered, e.g. in terms of flow rate) to the total flow of water exiting water heater 100 through hot water outlet fitting 112 (including both the hot water flowing from the tank interior and the cold water from the bypass conduit) may be about 5 percent to about 10 percent, about 10 percent to about 15 percent, about 15 percent to about 20 percent, about 20 percent to about 25 percent, about 25 percent to about 30 percent, about 5 percent to 15 percent, about 15 percent to about 25 percent, about 10 percent to 20 percent, about 20 percent to about 30 percent, about 5 percent to 15 percent, about 15 percent to about 30 percent, about 10 percent to about 25 percent, or about 5 percent to about 30 percent, e.g. depending on the ratio of the cross-sectional area of the generally cylindrical tube portion of bypass conduit 400 to the cross-sectional area of generally cylindrical outlet 112.

The water heater may be a closed system. As such, the mass flow rate of the water entering the water heater 100 ($\dot{m}_{in}$) may be equal to the mass flow rate of the water exiting water heater 100 ($\dot{m}_{out}$).

$$\dot{m}_{in}=\dot{m}_{out} \quad \text{Eqn. 1}$$

The mass flow rate of water entering the water heater 100 ($\dot{m}_{in}$) may include the mass flow rate of the water diverted by bypass 400 ($\dot{m}_{bypass}$) and the water flowing through dip tube 160 ($\dot{m}_{diptube}$).

$$\dot{m}_{in}=\dot{m}_{bypass}+\dot{m}_{diptube} \quad \text{Eqn. 2}$$

The mass flow rate of the water exiting the water heater ($\dot{m}_{out}$) may include the mass flow rate of the cold water diverted by bypass conduit 400 ($\dot{m}_{bypass}$) and the hot water flowing from tank interior volume 108 ($\dot{m}_{hot}$).

$$\dot{m}_{out}=\dot{m}_{bypass}+\dot{m}_{hot} \quad \text{Eqn. 3}$$

The cold water bypass ratio (x) may be the mass flow rate of the water diverted by bypass conduit 400 ($\dot{m}_{bypass}$) divided by the mass flow rate of the water entering water heater 100 ($\dot{m}_{in}$).

$$x=\dot{m}_{bypass}/\dot{m}_{in} \quad \text{Eqn. 4}$$

Applying and simplifying an adiabatic temperature mixing process at the hot water outlet fitting to Eqn. 4, the cold water bypass ratio (x) may be expressed as:

$$x=T_{hot}-T_{out}/T_{hot}-T_{in} \quad \text{Eqn. 5.}$$

Where T is the temperature associated with the respective mass flow rates.

The internal fluid passage defined by bypass conduit 400 is fixed open, in that there are no valves in the fluid passage that can be controlled, or that can otherwise act, to close fluid flow, or to limit fluid flow to less than would occur through the unobstructed fixed open internal fluid passage of the bypass conduit, between inlet pipe 110 and outlet fitting 112. Thus, the diameter and length of the internal fluid passage of bypass conduit 400 defines the cold water bypass ratio as described above.

Water heater 100 may control the delivery temperature, e.g. the temperature of the water exiting water heater 100 via outlet 112, based on the predetermined low and high threshold values, i.e. set points, maintained by the processing circuitry associated with water heater 100, and the ratio of the cold water flow to the total output water flow, which in turn depends on the cold water bypass ratio. That is, and as described above, the water heater system maintains the water heater tank water at a temperature that may vary between the high and low set points. Given this controlled, yet variable, tank water temperature, and the cold water bypass ratio (a fixed bypassing ratio) as described above, the temperature of the water output from fixture 112 at the moment a hot water outlet is opened (assuming the tank water is already fully heated), and water flow thereby begins, is predictable. From the initial flow, the length of time that the tank output can maintain an output water temperature at or near this predictable temperature depends on the volume of water in the tank that is initially maintained between the set points and the ratio of bypass water flow to overall output water flow. Since the temperature range between the set points is higher than the predicated temperature, this period of time is longer than it would be for the same water tank in the absence of the cold water bypass.

Figure 5:
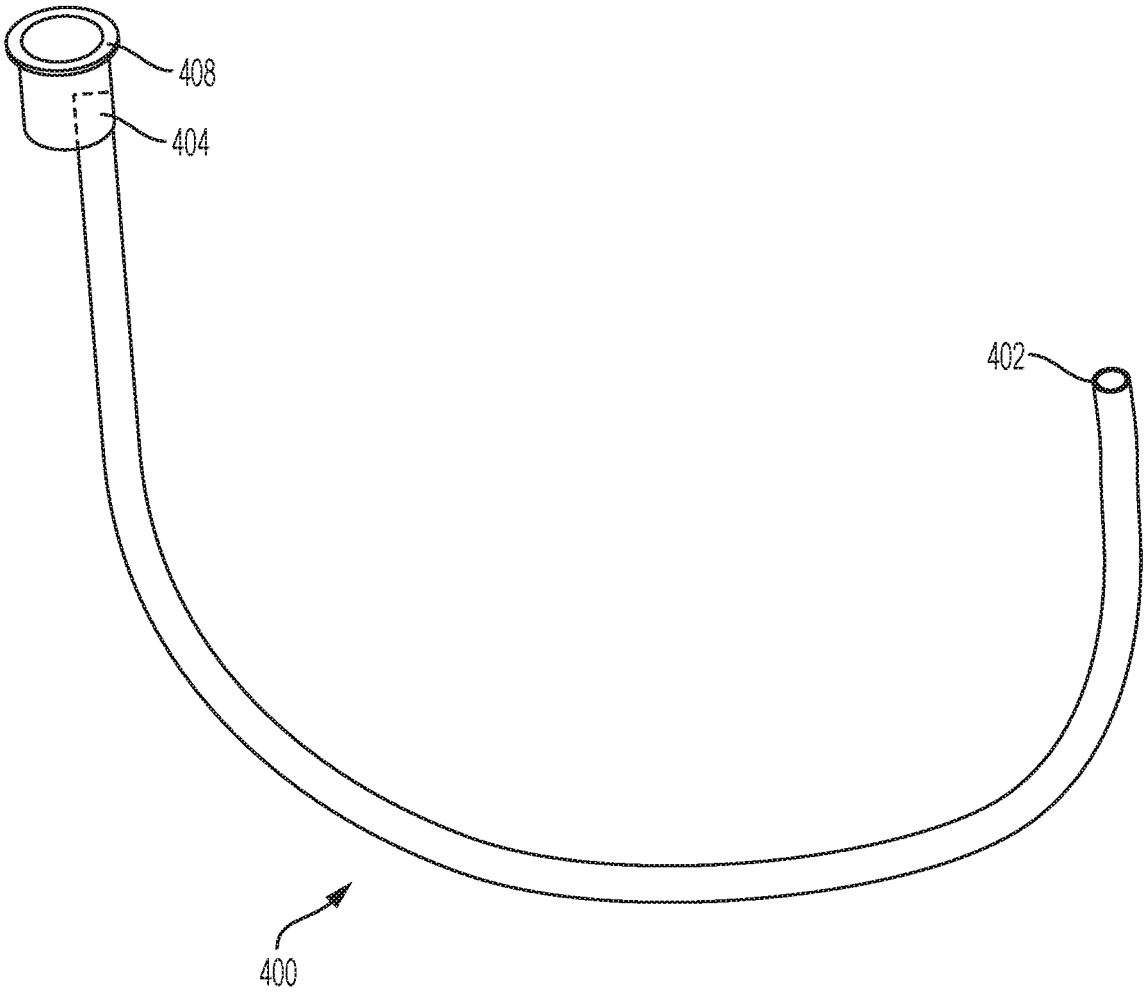
FIG. 5 is a perspective view of a bypass according to an example embodiment.

FIG. 5 illustrates an example bypass conduit 400 according to an example embodiment. Bypass conduit 400 may have a substantially U shape form, and be formed of a rigid material, such as a structural polymer, a high density polymer with temperature resistive properties, metal, or the like. Bypass conduit 400 may define a tube including a receiving end 402 and a discharge end 404, with a retention element 408 disposed at discharge end 404. In some embodiments, the retention element may be integrally formed with bypass conduit end 404, but in other embodiments, the conduit's main tube portion and the retention element may be distinct components, connected by suitable means such as adhesive or welding. In an example embodiment, discharge end 404 of the main tube portion extends into retention element 408, which in this example is a substantially cylindrical tube section with an inner diameter greater than the outer diameter of the main tube portion and its end 404.

Retention element 408 may be configured to be operably coupled to the periphery of hot water outlet fitting 112 (FIGS. 1-4), and in this example hot water outlet fitting is received within and attached to the cylindrical tube-shaped retention element 408. Retention element 408 may be operably coupled to hot water outlet fitting 112 by a tension or friction fit between the two components (in embodiments in which outlet fitting 112 is received by retention element 408) or by other means, such as by adhesive, a threaded connection between the two cylindrical peripheries of the components, a hose clamp, welding, or the like. In one embodiment (see FIG. 9), outlet fitting 112 includes a flange about its outer periphery that rests on the outer surface of the tank, thereby preventing the fitting from falling into the tank and providing a connection surface. Retention element 408 may be inserted into the aperture for outlet 112 from above, and prior to attachment of outlet 112, so that its upper peripheral flange (see FIG. 5) rests on the upper, outer tank surface. Outlet 112 may be thereafter placed onto retention element 408, so that the through-passage of outlet 112 is concentric with the through-passage of retention element 408 and so that the peripheral flange of outlet 112 rests on the peripheral flange of retention element 408, allowing both devices to be attached to the outer surface of the tank, e.g. by welding and/or adhesive with a suitable sealant. In another embodiment, outlet fitting 112 may have a section that extends into the through-passage of retention element 408.

Figure 6:
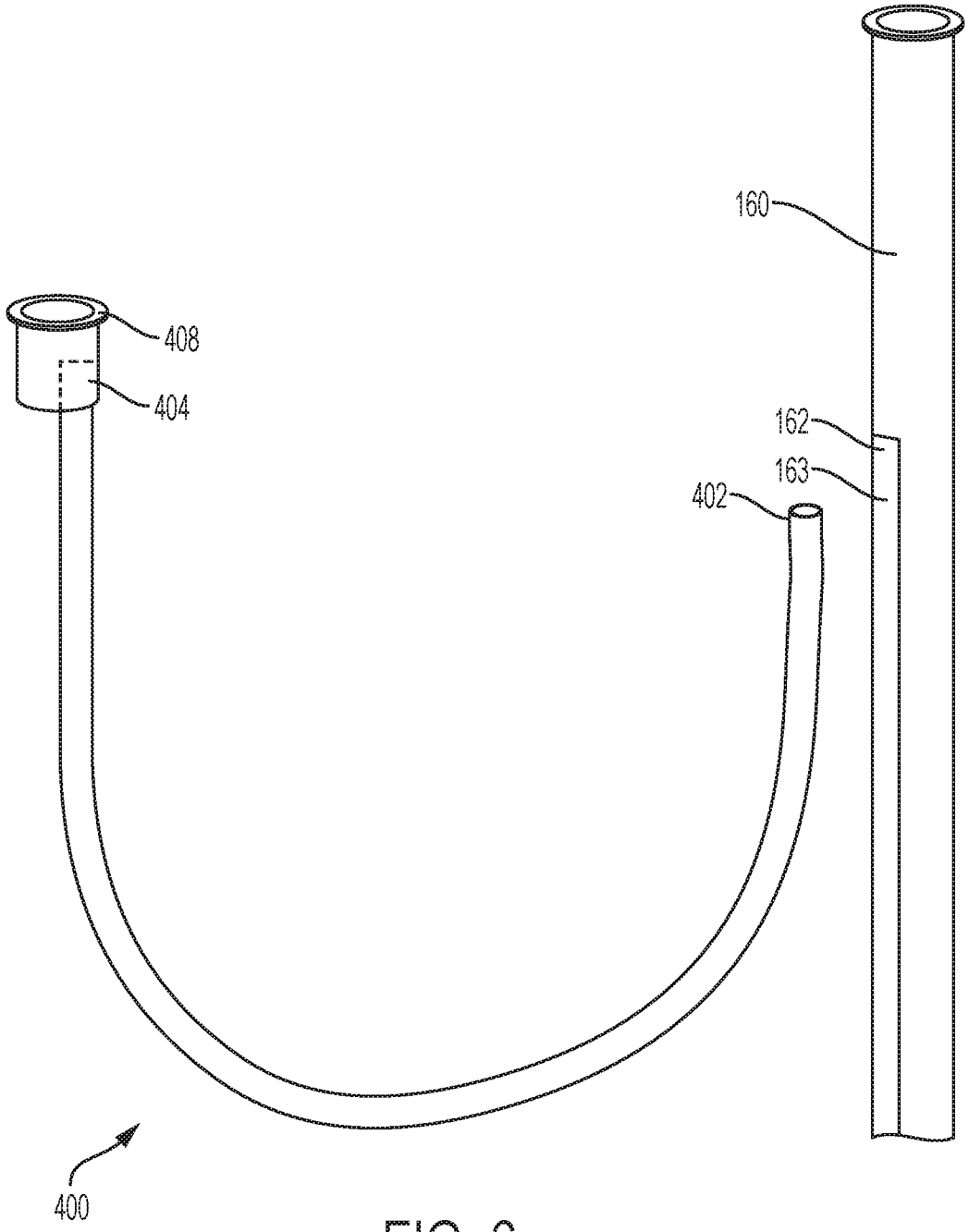
FIGS. 6 and 7 are partial perspective views of a bypass and dip tube assembly according to an example embodiment.
Figure 7:
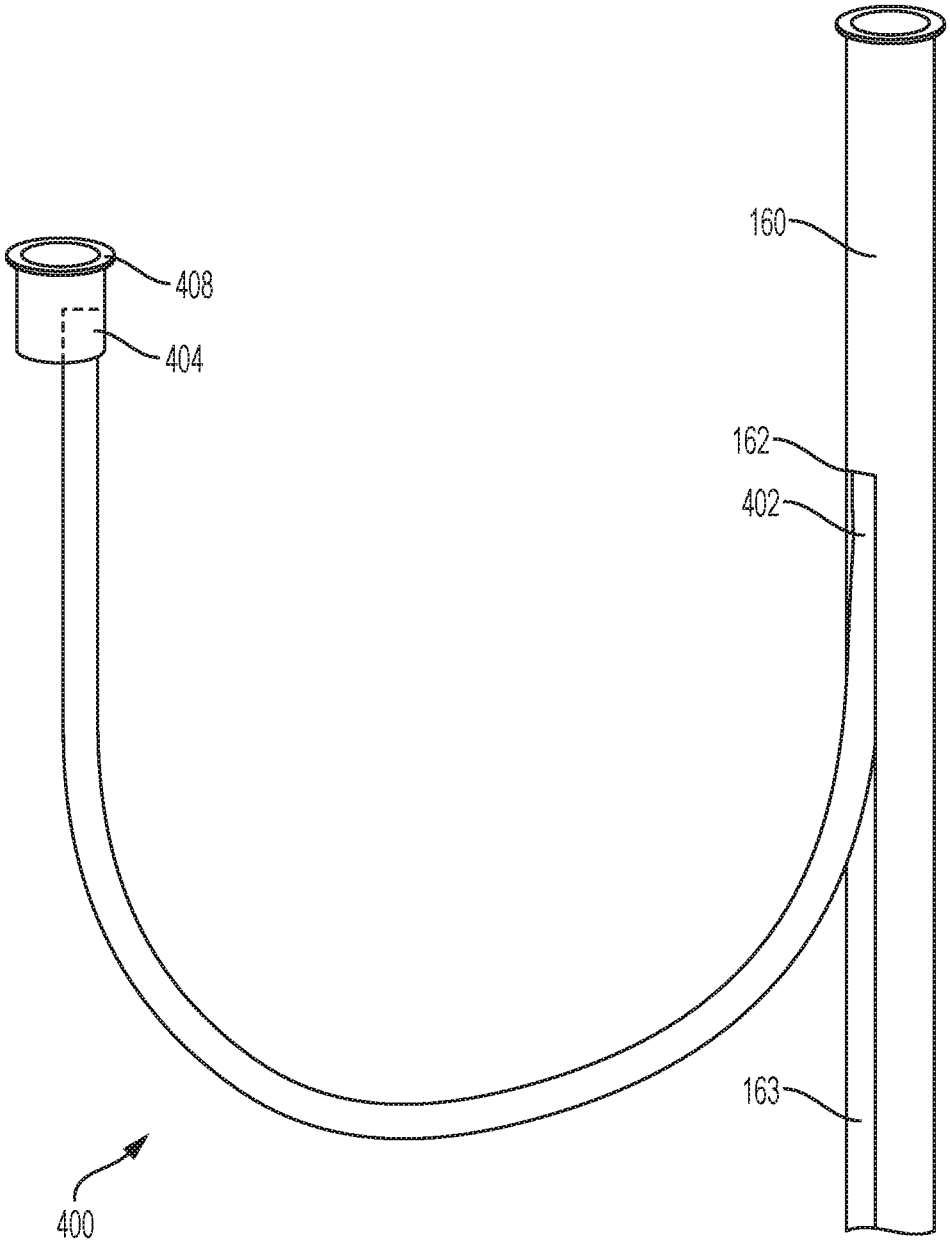

FIGS. 6 and 7 illustrate an example bypass conduit 400 and dip tube 160 according to an example embodiment. Receiving end 402 of bypass conduit 400 may be operably coupled, e.g. in fluid communication with, the interior fluid passage of dip tube 160 through an aperture 162 formed in the side wall of the dip tube 160. Dip tube 160 may include a substantially U shaped indention 163 in its otherwise substantially cylindrical side wall to thereby form an opening (aperture 162) in the side wall between the top of the indention and the adjacent, still-cylindrical part of the side wall. Receiving end 402 of bypass conduit 400 may be inset into U shaped indention 163, such that at least a portion of receiving end 402 of bypass conduit 400 extends in the direction of extension of dip tube 160. That is, if the long, main tube portion of bypass conduit 400 is considered to define a longitudinal centerline through its interior fluid passage, in the direction of the conduit's elongation and perpendicular to the conduit interior's circular cross-section, that longitudinal centerline, as it extends through end 402, is generally parallel to the longitudinal centerline of the interior fluid passage of dip tube 160, where the dip tube's longitudinal centerline extends in the direction of the dip tube's elongation and perpendicular to the dip tube interior passage's circular cross-section. As a result, since the direction of flow of cold water into the dip tube is parallel to the dip tube longitudinal centerline, and therefore parallel to the bypass tube's centerline at end 402, end 402 is aligned within the interior of dip tube 160.

Figure 8A:
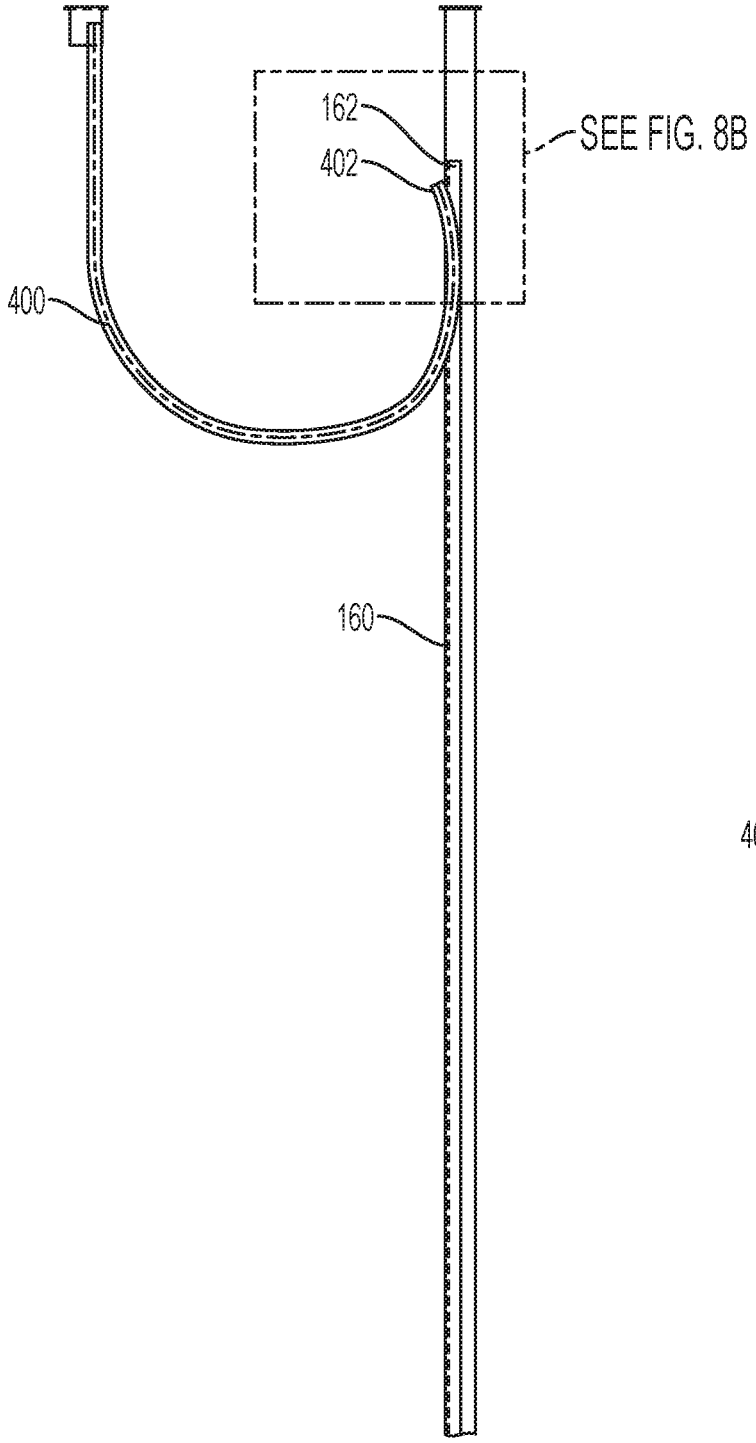
FIGS. 8A-8D are cross-sectional views of the connection of a receiving end of the bypass and the dip tube according to an example embodiment.
Figure 8B:
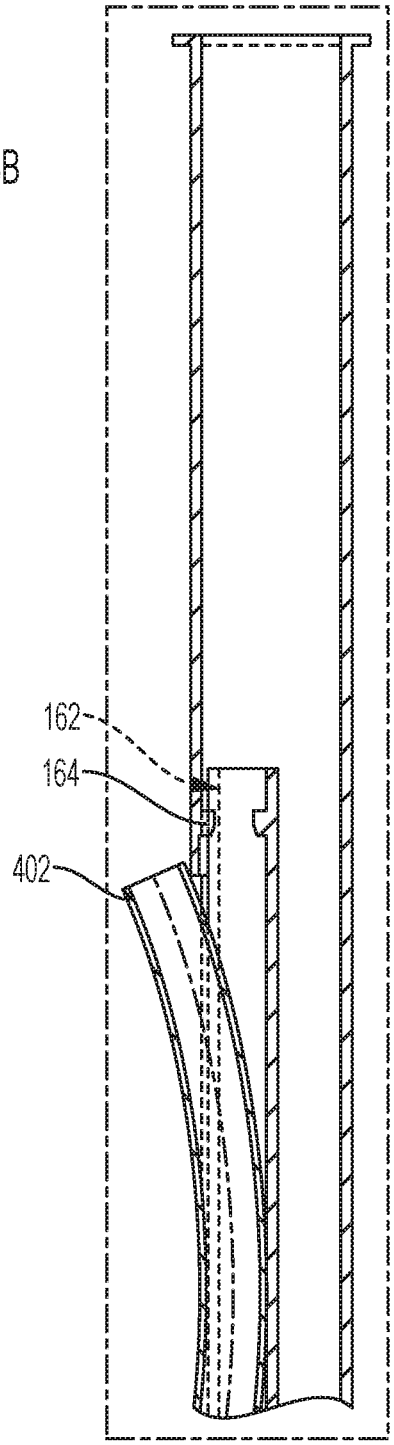
Figure 8C:
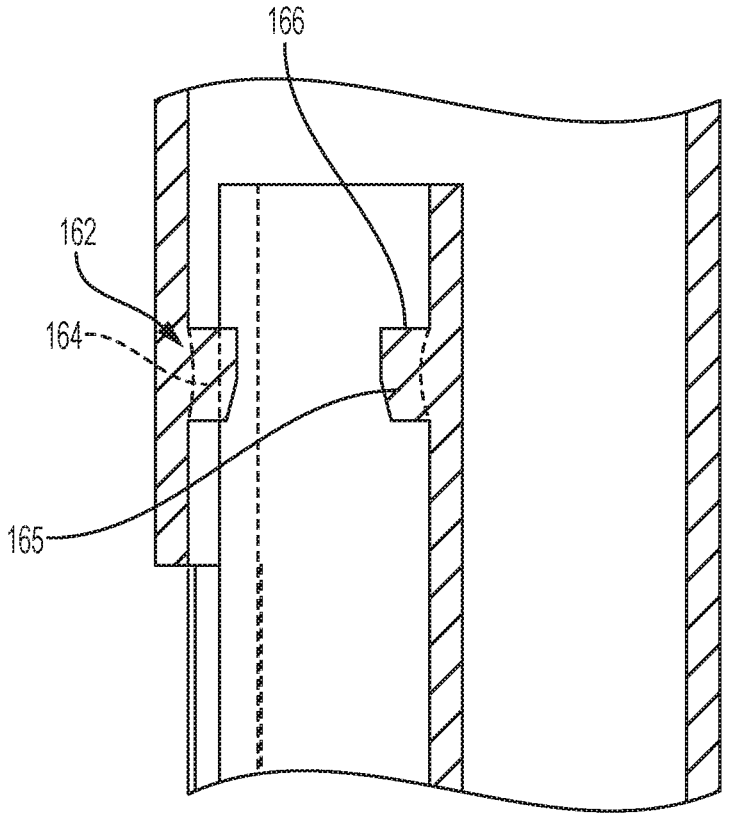
Figure 8D:
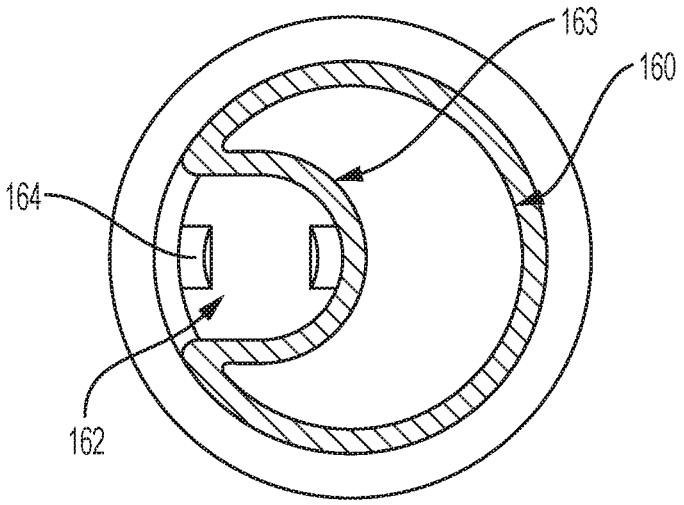

FIGS. 8A-8D illustrate cross-sectional views of the connection of end 402 of bypass conduit 400 and dip tube 160 and aperture 162, according to an example embodiment. FIG. 8A depicts dip tube 160 and bypass conduit 400 with receiving end 402 of dip tube 160 removed from aperture 162, but with the main tube portion of bypass conduit 400 placed against indention 163 (FIG. 7) in the dip tube side wall, just prior to the insertion of end 402. FIG. 8B depicts detail A of FIG. 8A. Bypass conduit receiving end 402 may be inserted into aperture 162 and retained in aperture 162 in position with respect to the dip tube by a pair of opposing aperture retention elements 164. Aperture retention elements 164 may include barbs, threads, compression rings, or the like. In the example depicted in FIG. 8C, aperture retention elements 164 include barbs or projections that extend inward, into aperture 162, from the inner surface of dip tube 160, on one side of aperture 162, and from the outer surface of indention 163, on the opposing side of aperture 162. Each barb includes an angled first edge 165 which may allow for a portion of receiving end 402 to pass over the barb, and a second edge 166 at about a right angle to the side wall of the dip tube 160 which may resist or prevent receiving end 402 from withdrawing from dip tube 160 (where end 402 is provided with a radial extension from its outer surface that would thereby catch on edge 166). In some embodiments, aperture 162 may include a lip or protrusion to stop the insertion of the receiving end 402 of bypass conduit 400 at a predetermined depth, such as ¼ inch, ½ inch, or the like. FIG. 8D illustrates a transverse cross-section of dip tube 160. The cross-section of the side wall of dip tube 160 has a substantially circular shape. The side wall of dip tube 160 may include a substantially U shaped indentation 163 at aperture 162 to allow for alignment of receiving end 402 of bypass conduit 400, as described herein.

Figure 9:
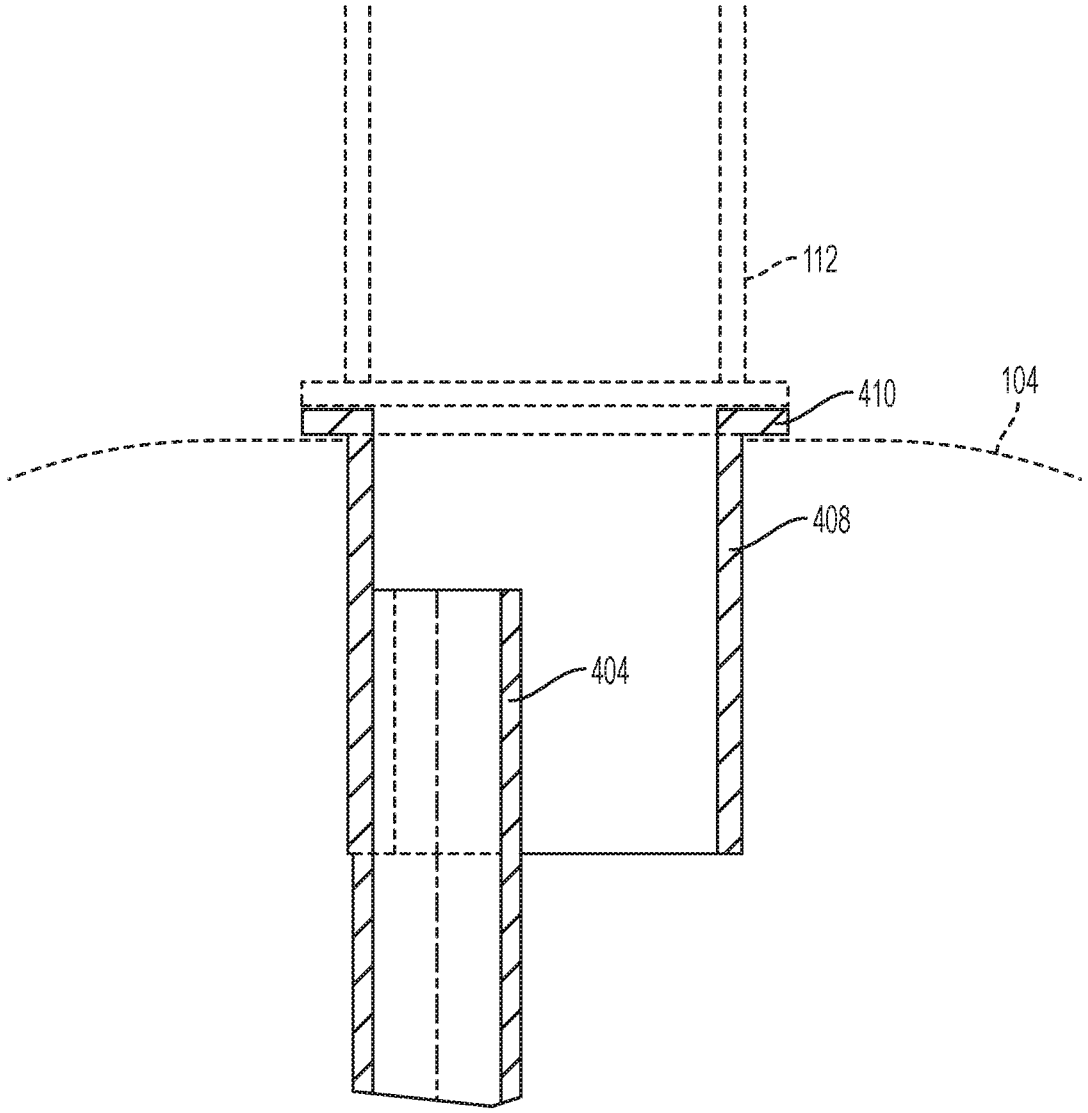
FIG. 9 is a cross-sectional view of the discharge end of the bypass according to an example embodiment.

FIG. 9 illustrates a cross-sectional view of discharge end 408 of bypass conduit 400 according to an example embodiment. Discharge end 404 of bypass conduit 400 may include a retention element 408, as discussed above. In the depicted example, retention element 408 is formed integrally to discharge end 404. Discharge end 404 may be disposed near or within the retention element 408. Retention element 408 may be configured to be operably coupled about an outer or inner periphery of hot water outlet fitting 112. As noted above, retention element 408 may be operably coupled to hot water outlet fitting 112 by tension, friction, threads, compression rings, hose clamps, or the like. In the depicted example, the retention element is operably coupled to hot water outlet fitting 112 by attachment of the outer flanges of the two structures, e.g. by welding, where the flanges are in turn attached to the outer tank surface. In another embodiment, hot water outlet fitting 112 additionally includes a lower portion that is inserted into the interior fluid passage of retention element 408 near or abutting discharge end 404 of bypass conduit 400. Discharge end 404 of the bypass conduit may extend in the direction of extension of the hot water outlet fitting 112, such that there is minimal resistance to flow from bypass conduit 400. As described above with respect to the attachment of end 402 into the dip tube, the alignment of end 404 with outlet fitting 112 in this example refers to a parallel disposition of the main bypass tube's longitudinal centerline with respect to the longitudinal centerline of the interior of outlet fitting 112.

In an example embodiment, the retention element may have a mounting lip 410 that extends radially wider than the through-hole through head portion 104, thereby to preventing the retention element from passing through head portion 104. Mounting lip 410 is disposed external to interior volume 108 of water heater 100 (FIG. 1). In some example embodiments, mounting lip 410 may form at least a portion of a water seal for the penetration associated with the hot water outlet fitting 112.

In an example embodiment, a method of assembling water heater 100, including bypass conduit 400, may be provided. The assembly process may start when tank body 101, including top head portion 104 is already assembled, but outlet 112 and dip tube 106 are not yet assembled into the tank body or have been removed (i.e. the assembly method can be used to install the bypass conduit into a new tank or to retrofit a bypass conduit into a preexisting water tank assembly). The bypass/outlet assembly is inserted into the aperture of the head portion 104 for accommodating the outlet fitting, beginning with bypass tube end 402. To facilitate this insertion, bypass conduit 400 may be turned upside down, e.g. so that the substantially U shape of the curved portion of main tube portion of conduit 400 faces downward. When enough of conduit 400 is inserted into the tank interior so that the main curved portion is inside the tank interior, the operator may turn the bypass conduit right-side up, so that the U shape of the tube portion is right side up. The operator may then manipulate the conduit so that the end 402 extends up through the through hole through top 104 that accommodates inlet pipe 110/dip tube 106, so that end 402 extends to some degree outside top 104, and inserts a dip tube 106 into that through hole until indention 163 aligns with the protruding end 402 (see FIG. 6). The operator aligns conduit end 402 in indention 163, with end 402 proximate aperture 162 and opening toward aperture 162. The operator pushes conduit end 402 into indention 163/aperture 162, between projections 164, so that end 402 is retained in position in indention 163/aperture 162 by a friction fit between end 402 and projections 164, as indicated in FIG. 7. The operator then moves dip tube 106 down through the through-hole and into the water tank's interior volume, until end 402 of bypass conduit 400 moves back down into the tank interior and an upper flange (the dip tube cup) of the dip tube reaches the top of the tank. At the other end of the bypass conduit, the operator moves end 404 and tube section 408, which are at the distal end of a generally straight section of the tube portion of the conduit, downward through the through hole through which hot water fitting 112 is to be installed until tube section 408 is inserted into the through hole and flange 410 is flush with top head portion 104, where tube section 408 may be sealingly secured to the top surface of the tank by welding or other suitable techniques, about flange 410.

The formation of indentation 163 and aperture 162 is made in dip tube 160 at a predetermined distance from the upper end of the dip tube so that, when the dip tube is assembled in the water heater, the connection of bypass conduit end 402 and the dip tube is a predetermined distance, such as 3.6 inches, from head portion 104. The substantially U shape of the bypass 400 and the U shaped indention in the dip tube 160 may expedite and simplify the assembly process of bypass conduit 400, dip tube 160, hot water outlet fitting 112, and cold water inlet pipe 110. Because the connection between conduit end 402 and the dip tube is within tank volume 108 (FIG. 2), the connection need not be watertight.

In some embodiments, water heater 100 may be further configured for additional operations or optional modifications. In this regard, in an example embodiment, the bypass is an internal bypass disposed within the tank's interior volume. In an example embodiment, a receiving end of the internal bypass is disposed in a side wall of the dip tube. In some example embodiments, the receiving end of the internal bypass is disposed in a U shaped indention in the side wall of the dip tube. In an example embodiment, at least a portion of the receiving end of the internal bypass extends in a direction of extension of the dip tube. In some example embodiments, the receiving end is operably coupled to the side wall of the dip tube by friction or tension. In an example embodiment, a connection between the receiving end and the side wall of the dip tube is not water tight. In some example embodiments, a discharge end of the internal bypass is disposed within an opening of the outlet. In an example embodiment, a discharge end of the internal bypass includes a retention element disposed about a periphery of the outlet. In some example embodiments, the retention element is operably coupled to the periphery of the outlet by friction or tension. In an example embodiment, the bypass enables an outlet water temperature of water exiting the interior volume to be less than an ambient temperature of the water within the tank. In some example embodiments, a percentage of bypass water includes about ten to about twenty-five percent of an outlet flow. In an example embodiment, the bypass is formed from of a rigid material. In some example embodiments, the heating element includes an electric heating element or a fuel burning heating element. In an example embodiment, the water heater also includes a dip tube operably coupled to the inlet and configured to discharge supply water proximate to the heating element.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A water heater comprising:

a tank defining an interior volume having an inlet and an outlet;

a heating element disposed with respect to the volume to heat water within the tank;

a dip tube operably coupled to the inlet and configured to discharge supply water in a lower half of the interior volume; and a bypass conduit in fluid communication between the inlet and outlet so that the bypass conduit diverts to the outlet at least a portion of the supply water from the inlet when the supply water flows through the inlet, wherein the bypass conduit defines a fixed open fluid channel extending from the inlet to the outlet, the bypass conduit having no controllable valve disposed therein.

2. The water heater of claim 1, wherein the bypass conduit is disposed within the interior volume.

3. The water heater of claim 2, wherein an open first end of the bypass conduit is disposed in a side wall of the dip tube so that the at least a portion of the supply water, flowing within the dip tube, is received into the open first end.

4. The water heater of claim 3, wherein the open first end of the bypass conduit is received within a U shaped indention in the side wall of the dip tube at an aperture through the side wall of the dip tube.

5. The water heater of claim 3, wherein the open first end is received in an aperture formed in the dip tube so that a longitudinal center line of the fixed open fluid channel at the open first end is parallel to a longitudinal centerline of an internal fluid passage of the dip tube.

6. The water heater of claim 3, wherein the open first end is operably coupled to the side wall of the dip tube by friction or tension.

7. The water heater of claim 6, wherein a connection between the open first end and the side wall of the dip tube is not watertight.

8. The water heater of claim 3, wherein a discharge end of the bypass conduit is disposed within an opening of the outlet.

9. The water heater of claim 8, wherein a discharge end of the bypass conduit comprises a retention band disposed about a periphery of the outlet.

10. The water heater of claim 9, wherein the retention band is operably coupled to the periphery of the outlet by friction or tension.

11. The water heater of claim 1, wherein the bypass conduit enables an outlet water temperature of water exiting the interior volume to be less than a temperature of the water within the tank.

12. The water heater of claim 1, wherein a percentage of bypass water comprises about ten to about twenty-five percent of an outlet flow.

13. The water heater of claim 1, wherein the bypass conduit is comprised of a rigid material.

14. The water heater of claim 1, wherein the heating element comprises an electric heating element or a fuel burning heating element.

15. A water heater comprising:

a tank defining an interior volume having an inlet and an outlet;

a heating element disposed with respect to the volume to heat water within the tank; and a bypass conduit disposed within the interior volume, in fluid communication between the inlet and outlet so that the bypass conduit diverts to the outlet at least a portion of supply water from the inlet when the supply water flows through the inlet, wherein the bypass conduit defines a fixed open fluid channel extending from the inlet to the outlet such that a flow of the at least a portion of the supply water is controlled solely by a cross-sectional area of the bypass conduit.

16. The water heater of claim 15, wherein the bypass conduit enables an outlet water temperature of water exiting the interior volume at the outlet to be less than a temperature of the water within the tank.

17. The water heater of claim 15 further comprising a dip tube operably coupled to the inlet and configured to discharge the supply water in a lower half of the interior volume.

18. The water heater of claim 15, wherein a percentage of bypass water comprises about ten to about twenty-five percent of an outlet flow.

19. The water heater of claim 15, wherein the bypass conduit is comprised of a rigid material.

20. The water heater of claim 15, wherein the heating element comprises an electric heating element or a fuel burning heating element.

21. A water heater comprising:

a tank defining an interior volume having an inlet and an outlet;

a heating element disposed with respect to the volume to heat water within the tank;

a water inlet line attached to the tank in fluid communication with the interior volume so that, when connected to a pressurized water source, the water inlet line extends into the interior volume and injects water therein; a water outlet line attached to the tank in fluid communication with the interior volume so that, when the water outlet line is in fluid communication with a low pressure water source, the water outlet line draws water from the tank; and a water bypass conduit disposed within the interior volume in fluid communication with and extending between the water inlet line and the water outlet line so that the water bypass conduit diverts to the water outlet line at least a portion of water from the inlet when water flows through the inlet, wherein the water bypass conduit defines a fixed open fluid channel extending from the water inlet line to the water outlet line, wherein a flow of the at least a portion of supply water diverted to the outlet is controlled solely by a cross-sectional area of the water bypass conduit.

* * * * *